US005501834A

United States Patent [19]

Nakasuji et al.

[11] Patent Number: 5,501,834

[45] Date of Patent: Mar. 26, 1996

[54] NONMAGNETIC FERROUS ALLOY WITH EXCELLENT CORROSION RESISTANCE AND WORKABILITY

[75] Inventors: Kazuyuki Nakasuji, Nishinomiya; Masaki Takashima, Urawa, both of Japan

[73] Assignees: Sumitomo Metal Industries, Ltd., Osaka; Sanyo Special Alloys, Ltd., Shimotuka, both of Japan

[21] Appl. No.: 299,348

[22] Filed: Sep. 1, 1994

[30] Foreign Application Priority Data

Sep. 3, 1993 [JP] Japan ..... 5-219735

[51] Int. Cl.[6] ..... C22C 38/30; C22C 30/00

[52] U.S. Cl. ..... 420/36; 420/583

[58] Field of Search ..... 420/36, 74, 583

[56] References Cited

U.S. PATENT DOCUMENTS 4,207,381 6/1980 Aisaka et al. .
4,751,046 6/1988 Simoneau .

FOREIGN PATENT DOCUMENTS

336175A1 10/1989 European Pat. Off. .
54-011015 1/1979 Japan .
57123960 8/1982 Japan ..... 420/36

*Primary Examiner*—Deborah Yee
*Attorney, Agent, or Firm*—Burns, Doane, Swecker & Mathis

[57] ABSTRACT

A Ni free ferrous nonmagnetic alloy having excellent corrosion resistance and workability and high cost performance is described.

The alloy comprises, by weight, 9 to 25% Cr, 3 to 35% Mn, 3 to 40% Co and the balance Fe and incidental impurities, and sum of Mn and 0.6Co is in accordance with a general relationship as indicated by formula ①, and preferably a restricted relationship as indicated by formula ②.

$$19\% \leqq Mn + 0.6\,Co \leqq 40\% \quad ①$$

$$22\% \leqq Mn + 0.6\,Co \leqq 36\% \quad ②$$

One type of alloy of this invention further containing 0.02 to 2% Ag has excellent machinability as well as corrosion resistance, workability and nonmagnetism.

12 Claims, No Drawings

NONMAGNETIC FERROUS ALLOY WITH EXCELLENT CORROSION RESISTANCE AND WORKABILITY

FIELD OF THE INVENTION

This invention relates to a nonmagnetic alloy having excellent corrosion resistance and workability and, more particularly, to a nonmagnetic Fe—Cr—Mn—Co system alloy or Fe— Cr—Mn—Co—Ag system alloy having excellent physical and chemical properties which is used in manufacturing articles in constant contact with human body.

THE PRIOR ART

Some austenitic stainless steels standardized by JIS (Japanese Industrial Standards) as SUS 302 or SUS 316, and some Ni base alloys are known to be nonmagnetic alloys which have excellent corrosion resistance and workability.

Materials for making everyday items in contact with the body, such as wrist watch cases and spectacle frames, are usually selected from metallic materials for its excellent corrosion resistance and workability. Some of false teeth, artificial joints and similar implants to the body are also made of metallic materials. These materials are usually required to be nonmagnetic as well as having corrosion resistance and workability.

Among typical metallic materials having such overall physical and chemical properties, there are the above-mentioned austenitic stainless steels and Ni base alloys which are widely used in making everyday articles other than surgical items and artificial implants. For example, an alloy for making a frame for a pair of spectacles, disclosed in Japanese Patent Public Disclosure (JPPD) 60-24175, is one such improved austenitic stainless steel.

The austenitic stainless steel generally contains element Ni as a main component, as does the austenitic steel disclosed in the JPPD 60-24175. As it has been suggested in recent years that Ni may cause allergic disorders and sometimes skin cancer, some people are anxious about use of alloys containing Ni, such as stainless steels and Ni base alloys. When these alloys are used in ornamental goods, such as wrist watch cases and spectacle frames, they are in constant contact with human skin. Implants and medical articles, sanitary articles, table ware, kitchen utensils and electrical articles also have direct contact with the human body. Some European countries have already started to regulate the Ni content of materials for making ornamental goods such as spectacles frames and wrist watch cases.

Under these circumstances, in place of nickel silver (a kind of Ni—Cu alloy) and Ni base alloys, in such ornamental items, attention has turned to Ti or Ti base alloys, or Co base alloys.

Zr,Zr base alloys, Ta,Ta base alloys, and Co—Cr—Mo system alloys have also been proposed as substitute materials for Ni containing alloys. All these alloys are not only corrosion resistant but also nonmagnetic. These alloys are, however, too expensive to use in making ornamental articles.

Japanese Patent Laid-Open 63-11653 (corresponding to U.S. Pat. No. 4,751,046) discloses an Fe base alloy containing, by weight, 8 to 30% Co and 10 to 30% Cr, as the main components. This alloy is highly cavitation corrosion resistant and used for making or repairing parts of hydraulic machines. The composition of the alloy, however, was determined without taking into account the influence of Ni on the human body and no attempt was made to eliminate Ni from the alloy composition.

SUMMARY OF THE INVENTION

One object of this invention is to provide an Ni free nonmagnetic metallic material with excellent corrosion resistance, workability, high cost performance, and which can be used in making articles that come into contact with the human body.

Another object of this invention is to provide such Ni free nonmagnetic alloy which has in addition to the above-mentioned physical and chemical properties, excellent machinability as well.

The fundamental alloy of this invention comprises, by weight, 9 to 25% Cr, 3 to 35% Mn, 3 to 20% Co, the sum of Mn and 0.6Co in accordance with the following formula ①, and the balance being Fe and incidental impurities.

$$19\% \leqq (Mn\% + 0.6Co\%) \leqq 40\% \quad ①$$

A modified alloy of this invention comprises, by weight, 9 to 25% Cr, 3 to 35% Mn, 3 to 20% Co, sum of Mn and 0.6Co satisfying the above-mentioned formula ①, up to 0.5% C, up to 0.5% N, up to 2% Si, up to 5% W, up to 5% Mo, up to 3.0% V, up to 0.5% Y, up to 1.0% Nb, up to 1.0% Ti, up to 1.0% Al, up to 0.05% of one or more rare earth elements, up to 0.2% S, up to 0.2% Se, up to 0.2% Te, up to 0.2% Zr, up to 0.2% Ca, up to 0.2% Pb and the balance being Fe and incidental impurities.

In order to obtain another modified alloy with improved machinability, 0.02 to 2% Ag may be added to any of the above-mentioned fundamental and modified alloys.

If these alloys are subjected to a manufacturing process involving a cold-working step after a hot-working step, the relationship between the Mn content and 0.6Co content may be preferably adjusted in line with the following formula ②.

$$22\% \leqq (Mn\% + 0.6Co\%) \leqq 36\% \quad ②$$

Typical uses or products of the alloy of this invention are as follows;

1. spectacle frames, wrist watch cases and other ornaments and everyday items.
2. table ware, kitchen ware and sanitary ware.
3. electric and electronic goods.
4. surgical articles and artificial implants.

DETAILED DESCRIPTION OF THE INVENTION

Among relatively low cost, corrosion resistant and nonmagnetic ferrous alloys, there are austenitic stainless steels (Fe—Cr—Ni alloy) wherein Ni serves to stabilize an austenitic microstructure of the stainless steel.

The inventors have conducted various studies with a view to economically providing a Ni free nonmagnetic alloy, and found that the Fe base alloy with the above-mentioned chemical compositions has excellent corrosion resistance and workability. In this alloy Mn, in the same way as Ni, serves to stabilize the nonmagnetic austenite structure, Cr serves to ensure corrosion resistance, and Co serves to stabilize the structure and nonmagnetic property and improve workability as well.

These three alloying elements in their preferred ranges of contents are the essential parts of the alloy of this invention.

The modified alloy further comprises one or more optional alloying element, i.e., C,N,Si,W,Mo,V,Y,Nb,Ti,Al, one of more rare earth elements, S,Se,Te,Zr Ca and Pb, together with the essential Mn,Co and Cr, in order to improve some physical properties of the fundamental alloy.

The further modified alloy additionally comprises Ag together with the above-mentioned indispensable and optional alloying elements in order to obtain an alloy having high machinability.

As outlined above, the ferrous alloys of this invention exhibit overall physical and chemical properties caused by the appropriate combination of the above-mentioned alloying elements in their preferred range of contents thereof.

Next the behavior and function of each alloying element will be described in more detail as well as the technical reason for defining the content of each alloying element, wherein percent represents percent by weight.

Cr: Cr is an essential element to ensure corrosion resistance of the ferrous alloy of this invention. However, an excessive amount of Cr is detrimental to workability of the alloy. In view of this, the Cr content should be in the range of 9 to 25%.

Mn: The Mn incorporated in the ferrous alloy with Co contributes by forming an austenitic structure and stabilizes the nonmagnetic properties of the alloy. The Mn does not produce any detrimental effects unlike Ni. The minimum content capable of exhibiting the austenire forming effect is 3%. On the other hand, if the amount of the Mn exceeds 35%, the workability is drastically reduced. Consequently, the Mn content should be in the range of 3 to 35%.

Co: The Co incorporated in the ferrous alloy stabilizes the austenitic structure thereby ensuring the nonmagnetism of the alloy and producing high corrosion resistance and workability. If the amount of Co is less than 3%, the resultant alloy will not exhibit the stable austenitic structure and the desired level of workability. On the other hand, if the amount of Co is more than 40%, the nonmagnetism cannot be obtained and workability tends to decrease. Thus, the Co content should be in the range of 3 to 40%.

In consideration of the combined effects of Mn and Co, these two elements are required to satisfy the relationship defined by the above-mentioned formula ①. If "Mn%+0.6 Co%" is less than 19%, the nonmagnetism of the alloy will disappear, whereas, if the value of the formula is more than 40%, workability will be reduced.

Additionally, if the "Mng +0.6 Co%" is less than 22%, although the ferrous alloy is able to exhibit the nonmagnetic phase in a hot-worked state, it may possibly exhibit magnetism if subjected to further cold-working due to the "working induced transformation". On the other hand, if "Mn%+0.6 Co%" exceeds 36%, cold-workability of the ferrous alloy will be reduced to an undesirable level. Accordingly, if the ferrous alloy of this invention is used in making any appropriate articles by a method involving a cold-working step, the relationship between "Mn%+0.6 Co%" should be adjusted to be in accordance with the above-mentioned formula ②.

Ag: The Ag incorporated in the ferrous alloy is extremely effective in improving its machinability, without decreasing workability and causing detrimental effects on the human body. As shown in Table 3, Ag content of more than 0.02% remarkably improves machinability of the alloy. On the other hand, an Ag content of over 2% causes a saturation of machinability improvement and leads to a decrease in workability. The Ag content, therefore, should fall in the range of 0.02 to 2%.

In addition to the above-mentioned essential alloying elements and the balance of Fe and incidental impurities, one or more of the following optional alloying elements can also be contained in the ferrous alloy of this invention.

C, N: Although C and N are effective in stabilizing the austenitic structure and improving tensile strength, they form Cr-carbide and/or Cr-carbonitride which are detrimental to the workability of the alloy. Accordingly, both the C content and the N content should be as low as possible, e.g., below 0.5% respectively.

Si: Si serves as a deoxidizing agent in the molten ferrous alloy and is effective to increase tensile strength thereof. However Si is detrimental to workability. The Si content should therefore be not more than 2.0%.

W, Mo and V: These elements are effective in improving the elasticity and hardness of the ferrous alloy. Any desired amount of one or more of these elements can be incorporated into the alloy, but excessive amounts of them are detrimental to the workability of the alloy. Accordingly, the content of W or Mo should be less than 5.0% and the V content should be less than 3.0%.

S, Be, Te, Zr, Ca and Pb: Each of these elements can be added to the ferrous alloy, if greater machinability of the alloy is required. Since excess amounts of these elements are detrimental to workability and toughness of the alloy, the content of each of these elements should be not more than 0.2%.

Nb, Ti and Al: These elements are effective in increasing the tensile strength of the alloy and therefore desired amounts of one or more of these elements can be added to the alloy in proportion to the tensile strength which is required. However, if excessive amounts of these elements are added to the alloy, its toughness will be decreased. The content of each of these elements should therefore be not more than 1.0%.

Y: Y forms a solid solution in the ferrous alloy and is preferentially oxidized before the other elements in the alloy at high temperatures, thereby to improve oxidation resistance thereof. Accordingly, desired amounts of Y may be added to the alloy in proportion to the degree of oxidization resistance which is required. However, an excessive amount of Y is detrimental to workability, so the Y content should be less than 0.5%.

Rare earth elements: The rare earth elements serve as deoxidizing agents in the ferrous alloy thereby improving oxidation resistant properties. Accordingly, desired amounts of one or more of the rare earth elements, for example in the form of "misch metal" can be added to the ferrous alloy in proportion to the degree of desired properties which are required. However, excess amounts of the rare earth elements decrease workability of the alloy. The content of each rare earth element should be not more than 0.05%.

Among the incidental impurities, P worsens the workability of the alloy, and accordingly the P content should be defined below 0.1%. Ni which usually is carried by Co can be contained in the alloy but it should be at a level as low as possible. The acceptable upper limit of the Ni content is 2.0%.

The ferrous alloy of this invention can be produced by any one of known melting methods and applied to the practical uses as cast or as hot-worked (forged, rolled) after casting, and, if necessary, cold-worked into the desired shapes. The alloy can be formed into the desired shapes using special methods of powder metallurgy or rapid liquid quenching methods. The so formed alloy articles can be subjected to a solution treatment, aging or any other special heat-treatment in accordance with the physical and chemical properties required to the final products of the alloy.

EXAMPLE1

The effects of the Mn content, the Co content and the combination of the Mn and Co contents on the magnetism and workability of the alloys of this invention were investigated.

A series of alloy specimens containing 17% Cr and 0.2% Si (deoxidizing agent), both kept at constant level, and variable amounts of Mn and Co, were melted in a vacuum and cast into billets of 70 mm diameter and 300 mm length. The alloy billets were heated to 1200° C. and hot-forged into bars of 20 mm diameter.

The magnetic property and workability of each of the cast billets and hot-forged bars were then investigated.

The magnetic property of the billets and bars was evaluated by a simple test as to whether or not each of the billets was attracted by a magnet. Workability was evaluated by a visual inspection of the surface conditions of the hot-forged bars.

The test results are set forth in Table 1 below, wherein"x" in a column of nonmagnetic property means that a magnet piece attracts a test specimen and "○" means that the magnet piece does not attract the specimen, and "x" in a column of workability means that a surface crack is caused by a hot-forging step and "○" means that no crack is observed on the specimen surface.

It will be apparent from the Table 1 that:

A series of alloy specimens (Nos.12,13,14,15,16 and 17), containing either Mn or Co, cannot simultaneously be nonmagnetism and have good workability. Another series of alloy specimens (Nos.18,19,20 and 21), containing both Mn and Co, but which does not satisfy the relationship that the value of "Mn%+0.6 Co%" must be more than 19%, can not exhibit nonmagnetism.

Alloy specimen No.24, which contains both Mn and Co but does not satisfy the relationship that the value of "Mn%+0.6 Co%" must be less than 40%, can exhibit nonmagnetism but only inferior workability. Alloy specimen No.25 satisfies the relationship ① as the value of "Mn%+0.6 Co%" amounts to 27.2%, but the Mn content is low (20%) and the Co content is high (42%). Accordingly, the specimen No.25 can not exhibit nonmagnetism and can only exhibit inferior workability.

Alloy specimens Nos.22 and 23, which satisfy the relationship ① as the values of "Mn%+0.6 Co%" amount to 22.2% and 31.2%, respectively, but contain insufficient Co, and exhibit inferior workability.

In comparison with the above-mentioned alloy specimens, the alloy specimens (No.1 to No.11), which contain 3 to 35% Mn and 3 to 40% Co and satisfy the relationship ①, exhibit both nonmagnetism and excellent workability. Additionally, permeability (μ) of these nonmagnetic materials, which do not attract any magnet piece, was measured and the values turned out to be 1.0 to 1.2. The proportion of austenite phase in a whole alloy mass in these nonmagnetic alloys was measured and turned out to be 58 to 49%.

TABLE 1

| Alloy Specimen | No. | chemical composition (wt. %) Fe | Cr | Mn | Co | Mn + 0.6 Co | Si | nonmagnetic property | workability |
|---|---|---|---|---|---|---|---|---|---|
| Alloys of this Invention | 1 | 60.8 | 17.0 | 16 | 6 | 19.6 | 0.2 | ○ | ○ |
| | 2 | 58.8 | 17.0 | 16 | 8 | 20.8 | 0.2 | ○ | ○ |
| | 3 | 56.8 | 17.0 | 16 | 10 | 22.0 | 0.2 | ○ | ○ |
| | 4 | 51.8 | 17.0 | 21 | 10 | 27.0 | 0.2 | ○ | ○ |
| | 5 | 42.8 | 17.0 | 30 | 10 | 36.0 | 0.2 | ○ | ○ |
| | 6 | 50.8 | 17.0 | 18 | 14 | 26.4 | 0.2 | ○ | ○ |
| | 7 | 52.8 | 17.0 | 18 | 12 | 25.2 | 0.2 | ○ | ○ |
| | 8 | 60.8 | 17.0 | 18 | 4 | 20.4 | 0.2 | ○ | ○ |
| | 9 | 40.8 | 17.0 | 4 | 38 | 26.8 | 0.2 | ○ | ○ |
| | 10 | 40.8 | 17.0 | 10 | 32 | 29.2 | 0.2 | ○ | ○ |
| | 11 | 57.8 | 17.0 | 10 | 15 | 19.0 | 0.2 | ○ | ○ |
| Comparative Alloys | 12 | 72.8 | 17.0 | — | 10 | 6.0 | 0.2 | x | ○ |
| | 13 | 62.8 | 17.0 | — | 20 | 12.0 | 0.2 | x | ○ |
| | 14 | 70.8 | 17.0 | 12 | — | 12.0 | 0.2 | x | ○ |
| | 15 | 64.8 | 17.0 | 18 | — | 18.0 | 0.2 | x | ○ |
| | 16 | 61.8 | 17.0 | 21 | — | 21.0 | 0.2 | ○ | x |
| | 17 | 58.8 | 17.0 | 24 | — | 24.0 | 0.2 | ○ | x |
| | 18 | 57.8 | 17.0 | 5 | 20 | 17.0 | 0.2 | x | ○ |
| | 19 | 62.8 | 17.0 | 10 | 10 | 16.0 | 0.2 | x | ○ |
| | 20 | 64.8 | 17.0 | 16 | 2 | 17.2 | 0.2 | x | ○ |
| | 21 | 62.8 | 17.0 | 16 | 4 | 18.4 | 0.2 | x | ○ |
| | 22 | 59.8 | 17.0 | 21 | 2 | 22.2 | 0.2 | ○ | x |
| | 23 | 50.8 | 17.0 | 30 | 2 | 31.2 | 0.2 | ○ | x |
| | 24 | 36.8 | 17.0 | 36 | 10 | 42.0 | 0.2 | ○ | x |
| | 25 | 38.8 | 17.0 | 2 | 42 | 27.2 | 0.2 | x | x |

EXAMPLE 2

Four series of alloy specimens containing 10.0% Cr, 13.0% Cr, 21.0% Cr and 24.0% Cr, with the constant Si content of 0.2% and variable Mn and Co contents (satisfying the relationship of formula ②) were melted in the same way as Example 1, formed into billets and hot-forged into bars of 20 mm diameter. The hot-forged bars were subjected to peeling to obtain bars of 18 mm diameter and then to cold-swaging to obtain specimens of 14 mm diameter.

Effects of the Mn content, the Co content and the combination of the Mn and Co contents on the nonmagnetism, workability and corrosion resistance of the alloy of this invention containing variable amounts of Cr, were investigated. The nonmagnetism and workability were measured in the same way as in the Example 1, and corrosion resistance was evaluated by the salt spray test standardized by JIB (Japanese Industrial Standards). The test results are set forth in Table 2.

The evaluation standard for nonmagnetism and workability is the same as that in the Table 1 relating to Example 1. "○" in the column of corrosion resistance means that neither discoloring nor pitting was observed on the specimen.

It can be ascertained from the Table 2 that even if the Cr content changed within a range as defined according to this invention, nonmagnetism, hot and cold workability, and corrosion resistance are kept at the desired levels so long as the Mn and Co contents are kept within the range defined in this invention.

TABLE 2

| Alloy Specimen | | chemical composition (wt. %) | | | | | | nonmagnetic | | corrosion |
|---|---|---|---|---|---|---|---|---|---|---|
| No. | | Fe | Cr | Mn | Co | Mn + 0.6 Co | Si | property | workability | resistance |
| Alloys of | 26 | 47.8 | 10.0 | 10.0 | 32.0 | 29.2 | 0.2 | ○ | ○ | ○ |
| this | 27 | 58.8 | 10.0 | 21.0 | 10.0 | 27.0 | 0.2 | ○ | ○ | ○ |
| Invention | 28 | 45.0 | 13.0 | 10.0 | 32.0 | 29.2 | 0.2 | ○ | ○ | ○ |
| | 29 | 55.8 | 13.0 | 21.0 | 10.0 | 27.0 | 0.2 | ○ | ○ | ○ |
| | 30 | 36.8 | 21.0 | 10.0 | 32.0 | 29.2 | 0.2 | ○ | ○ | ○ |
| | 31 | 47.8 | 21.0 | 21.0 | 10.0 | 27.0 | 0.2 | ○ | ○ | ○ |
| | 32 | 33.8 | 24.0 | 10.0 | 32.0 | 29.2 | 0.2 | ○ | ○ | ○ |
| | 33 | 44.8 | 24.0 | 21.0 | 10.0 | 27.0 | 0.2 | ○ | ○ | ○ |

EXAMPLE 3

The effect of the Ag content on the machinability of the alloy of this invention was investigated.

A series of alloys with variable Ag contents was melted in a vacuum, and cast into billets of 70 mm diameter and 300 mm length. The alloy billets were heated at 1200° C. and hot-forged into bars of 20 mm diameter.

A machining test was carried out by shaving the bar with a bit to cut off a round disc of a 5 mm thickness and 20 mm diameter. The test results are shown in Table 3.

In Table 3, the machinability of an alloy specimen No.52, which does not contain Ag, was assumed to be 100 (an index for evaluating the machinability, i.e., the amount of cuttings which a single bit can produce), and machinability of any alloy specimen other than No.52 was expressed by a ratio to the standard value 100. The higher the ratio is, the better the machinability.

It is apparent from the Table 3 that an alloy specimen (No.34) containing 0.02% Ag exhibits 1.2 times superior machinability compared with specimen No.52 which does not contain Ag, and that the higher the Ag content is, the better the machinability. On the other hand, the machinability of the specimens Nos.50 and 51, containing 2.50% Ag and 3.00% Ag respectively, cannot be clearly distinguished from that of specimen No.39 which contains 2.00% Ag. The specimens containing more than 2.50% Ag cause cracks on the surfaces thereof while they are being forged.

Separately, the hot-forged bars Nos.34 to 49 containing 0.02 to 2% Ag and of 20 mm diameter were subjected to peeling to obtain bars of 18 mm diameter, and further cold-swaging to obtain ones of 1 mm diameter. The resultant bars were observed to cause no surface cracks and exhibited excellent cold workability.

It can be concluded that in order to produce an alloy having excellent machinability as well as excellent hot and cold workability the Ag content should fall within a range of 0.02 to 2%.

TABLE 3

| Alloy Specimen | chemical composition (wt. %) | | | | | | |
|---|---|---|---|---|---|---|---|
| No. | Fe | Cr | Mn | Co | Si | Ag | machinability |
| 34 | Bal. | 17.0 | 16.0 | 10.0 | 0.2 | 0.02 | 123 |
| 35 | Bal. | 17.0 | 16.0 | 10.0 | 0.2 | 0.05 | 151 |
| 36 | Bal. | 17.0 | 16.0 | 10.0 | 0.2 | 0.10 | 198 |
| 37 | Bal. | 17.0 | 16.0 | 10.0 | 0.2 | 0.20 | 220 |
| 38 | Bal. | 17.0 | 16.0 | 10.0 | 0.2 | 1.00 | 233 |
| 39 | Bal. | 17.0 | 16.0 | 10.0 | 0.2 | 2.00 | 250 |
| 40 | Bal. | 10.0 | 16.0 | 10.0 | 0.2 | 0.10 | 195 |

TABLE 3-continued

| Alloy Specimen | chemical composition (wt. %) | | | | | | |
|---|---|---|---|---|---|---|---|
| No. | Fe | Cr | Mn | Co | Si | Ag | machinability |
| 41 | Bal. | 10.0 | 16.0 | 10.0 | 0.2 | 1.00 | 230 |
| 42 | Bal. | 13.0 | 16.0 | 10.0 | 0.2 | 0.10 | 200 |
| 43 | Bal. | 13.0 | 16.0 | 10.0 | 0.2 | 1.00 | 235 |
| 44 | Bal. | 21.0 | 16.0 | 10.0 | 0.2 | 0.10 | 192 |
| 45 | Bal. | 21.0 | 16.0 | 10.0 | 0.2 | 1.00 | 232 |
| 46 | Bal. | 17.0 | 10.0 | 32.0 | 0.2 | 0.10 | 198 |
| 47 | Bal. | 17.0 | 10.0 | 32.0 | 0.2 | 1.00 | 235 |
| 48 | Bal. | 17.0 | 30.0 | 10.0 | 0.2 | 0.10 | 190 |
| 49 | Bal. | 17.0 | 30.0 | 10.0 | 0.2 | 1.00 | 229 |
| 50 | Bal. | 17.0 | 16.0 | 10.0 | 0.2 | 2.50 | 253 |
| 51 | Bal. | 17.0 | 16.0 | 10.0 | 0.2 | 3.00 | 255 |
| 52 | Bal. | 17.0 | 16.0 | 10.0 | 0.2 | 0.00 | 100 |

EXAMPLE 4

The alloy of this invention was used in making a frame for a pair of spectacles.

Two types of alloys having compositions corresponding to specimens Nos.53 and 54 shown in Table 4 were melted in a vacuum and cast into billets of 70 mm diameter and 300 mm length. These billets were heated at 1200° C., hot-forged into bars of 20 mm diameter and subjected to peeling to obtain bars of 17 mm diameter. The bars were then cold-worked, drawn through a die into wires and heat treated to soften the wires. These steps were repeated several times to finally obtain wires of 3.2 to 1.8 mm diameter.

The tensile strength and the reduction of area of each wire after being cold-worked with a 50% working ration were 1500 MPa and 25%, respectively, neither was reduced by the addition of the Ag. After being subjected to the salt spray test for evaluating corrosion resistance, neither of the wires was discolored and both still exhibited excellent corrosion resistance without causing pitting defects.

These wires were subjected to cold-rolling, swaging, pressing etc. to produce temples, rims, nose pads, bridges and the other parts of a pair of spectacles. These parts were then welded to each other to make up a spectacles frame. Either of these alloy wires was capable of being used in the making into a frame for a pair of spectacles. The Ag containing type alloy of this invention is particularly outstanding in its machinability and brightening property. The alloy of this invention was therefore ascertained to be highly effective in making spectacles frames.

TABLE 4

| Alloy Specimen | | chemical composition (wt. %) | | | | | |
|---|---|---|---|---|---|---|---|
| No. | | Fe | Cr | Mn | Co | Si | Ag |
| Alloys of this Invention | 53 | Bal. | 16.5 | 18.0 | 14.0 | 0.2 | — |
| | 54 | Bal. | 16.5 | 18.0 | 14.0 | 0.2 | 0.1 |
| | 55 | Bal. | 16.5 | 10.0 | 32.0 | 0.2 | — |
| | 56 | Bal. | 16.5 | 10.0 | 32.0 | 0.2 | 0.1 |

EXAMPLE 5

A series of alloys of this invention, Nos.53 to 56, were applied in the ways outlined below, to make various products having a variety of shapes, as follows.

(1) The alloys were melted in a vacuum and cast into billets of 70 mm diameter and 300 mm length. The obtained billets were heated at 1200° C. and hot-forged into bars of 20 mm diameter.

(2) The billets were heated at 1200° C., subjected to rolling, piercing, and reducing to produce tubes of 60 mm outer diameter and 50 mm inner diameter.

(3) The billets were heated at 1200° C., hot-rolled to obtain sheets of 3 mm thicknesses and cold-rolled into a sheet of 1 mm thicknesses.

All of the above-mentioned workings and processes were able to be favorably applied to the billets without causing cracks on the articles.

By shaving, pressing or working those resultant bars, tubes and sheets, various items were produced e.g. ornamental goods like watch bands, kitchen utensils like spoons and forks, sanitary goods, bathtubs, and electric or electronic parts for audio and video products.

There was no problems regarding the machinability and workability of the alloy in manufacturing the articles. In addition, the nonmagnetism and corrosion resistance of the resultant products were satisfactory.

It will be apparent from the foregoing description that the alloy of this invention by applying thereto ordinary working methods was able to be used in manufacturing various articles.

It will be understood by those skilled in the art that various changes in the form and detail thereof may be made without departing from the scope and spirit of the claimed invention.

What is claimed is:

1. A nonmagnetic nickel-free alloy with excellent corrosion resistance and workability to be used for products in constant contact with the human body, said alloy consisting essentially of, by weight, 9 to 25% Cr, up to 2.0% Si, 3 to 35% Mn, 10 to 40% Co, the sum of Mn and 0.6 Co satisfying the formula $22\% \leqq Mn+0.6\ Co \leqq 36\%$, and the balance Fe and incidental impurities.

2. A nonmagnetic nickel-free alloy according to claim 1, wherein the sum of Mn and 0.6 Co satisfies the formula $22\% \leqq Mn+0.6\ Co \leqq 29\%$.

3. A nonmagnetic nickel-free alloy according to claim 1 or 2, further containing up to 0.5% C, up to 0.5% N, up to 5.0% W, up to 5.0% Mo, up to 3.0% V, up to 0.5% Y, up to 1.0% Nb, up to 1.0% Ti, up to 1.0% Al, up to 0.05% of one or more rare earth elements, up to 0.20% S, up to 0.20% Se, up to 0.20% Te, up to 0.20% Zr, up to 0.20% Ca and up to 0.2% Pb.

4. A nonmagnetic nickel-free alloy according to any one of the preceding claims 1 to 3, further containing 0.02 to 2% Ag.

5. A nonmagnetic alloy with excellent corrosion resistance and workability to be used for products in constant contact with the human body, said alloy comprising, by weight, 9 to 25% Cr, 3 to 35% Mn, 3 to 40% Co, the sum of Mn and 0.6 Co satisfying the formula $19\% \leqq Mn+0.6\ Co \leqq 40\%$, 0.02 to 2% Ag, and the balance Fe and incidental impurities.

6. A nonmagnetic alloy according to claim 5, wherein the sum of Mn and 0.6 Co satisfies the formula $22\% < Mn+0.6\ Co < 36\%$.

7. A nonmagnetic alloy according to claim 5, further containing up to 0.5% C, up to 0.5% N, up to 2.0% Si, up to 5.0% W, up to 5.0% Mo, up to 3.0% V, up to 0.5% Y, up to 1.0% Nb, up to 1.0% Ti, up to 1.0% A1, up to 0.05% of one or more rare earth elements, up to 0.20% S, up to 0.20% Se, up to 0.20% Te, up to 0.20% Zr, up to 0.20% Ca and up to 0.2% Pb.

8. A nonmagnetic alloy according to claim 5, further containing up to 2.0% Ni.

9. A nonmagnetic nickel-free alloy according to claim 1, wherein the Mn content is at least 18%.

10. A nonmagnetic alloy according to claim 5, wherein the Mn content is at least 18%.

11. A nonmagnetic nickel-free alloy according to claim 1, wherein the Si content is $\leqq 0.2\%$.

12. A nonmagnetic alloy according to claim 5, wherein the Si content is $\leqq 0.2\%$.

* * * * *